United States Patent [19]

Beckwith

[11] Patent Number: 4,580,315

[45] Date of Patent: Apr. 8, 1986

[54] HINGE ASSEMBLY FOR COMPARTMENT LID

[75] Inventor: John R. Beckwith, Rochester, Mich.

[73] Assignee: General Motors Corporation, Detroit, Mich.

[21] Appl. No.: 565,396

[22] Filed: Dec. 27, 1983

[51] Int. Cl.[4] ..... E05F 1/08

[52] U.S. Cl. ..... 16/308; 16/289; 16/306

[58] Field of Search ..... 16/308, 306, 280, 284, 16/289, 290, 303, 341, DIG. 36

[56] References Cited

U.S. PATENT DOCUMENTS

| | | | |
|---|---|---|---|
| 2,204,990 | 6/1940 | Haltenberger | 16/308 |
| 2,272,230 | 2/1942 | Voorhees | 16/306 |
| 2,743,476 | 5/1956 | Turner | 16/289 |
| 2,799,891 | 7/1957 | Ragsdale . | |
| 3,085,286 | 4/1963 | Whitehouse et al. . | |
| 3,476,375 | 11/1969 | Brasseur | 16/308 |

FOREIGN PATENT DOCUMENTS

| | | | |
|---|---|---|---|
| 803554 | 10/1958 | United Kingdom . | |
| 831717 | 3/1960 | United Kingdom . | |
| 939845 | 10/1963 | United Kingdom | 16/308 |
| 1086385 | 10/1967 | United Kingdom | 16/308 |

*Primary Examiner*—Donald R. Schran
*Assistant Examiner*—James L. Wolfe
*Attorney, Agent, or Firm*—William A. Schuetz

[57] ABSTRACT

A hinge assembly for a vehicle deck lid is disclosed. The hinge assembly includes a stationary hinge member, a hinge strap secured to the deck lid and pivotally connected to the stationary hinge member, a lever pivotally supported by the hinge member at a location spaced from the pivotal connection of the hinge strap, a torsion rod for biasing the lever into engagement with a roller rotatably carried by the hinge strap, the lever having a cam surface and the torsion rod having a bias such that it causes the deck lid to be automatically raised at a controlled rate upon the deck lid being opened.

3 Claims, 4 Drawing Figures

HINGE ASSEMBLY FOR COMPARTMENT LID

The present invention relates to a hinge assembly and, more particularly, to a hinge assembly for raising or lowering a trunk or deck lid to open and close a trunk compartment of an automotive vehicle.

Heretofore, trunk lid hinge assemblies for raising and lowering the trunk lid between open and closed position have been provided. These assemblies have included torque rods for assisting in raising the lid and biasingly holding the lid in its open position. For example, British Pat. No. 803554 shows a roller rotatably carried by a torque rod which biases the roller into engagement with a cam surface formed on a hinge strap which is pivotally connected to a stationary hinge member and secured to the lid. The patent to Whitehouse et al. U.S. Pat. No. 3,085,286, shows a torque rod which is biased into engagement with a roller rotatably supported by a pivotally supported hinge arm. In both of these patents the torque rod bias is such that it assists in the opening movement of the lid and holds it against a stop in the open position.

A disadvantage in the above discussed torque rod hinge assemblies is that it is difficult to manufacture torque rods which, when loaded, provide consistent uniform load characteristics so that each hinge assembly provides the same load assist. Also, manufacturing and tolerance variations in the torque rods and hinge assembly parts add to this disadvantage.

It has been found that by employing a pivotal lever or link having a contoured cam surface which is biased into engagement with a roller carried by the hinge strap, the load variations in the torque rods are not as critical and that more uniform load assists for the hinge assemblies are achieved.

Accordingly, an object of the present invention is to provide a new and improved hinge assembly for a swinging closure member, such as a deck lid, adapted to be raised and lowered to open and close an opening in the compartment of an automotive vehicle and in which the hinge assembly has a torque rod and lever arrangement which applies a controlled, substantially constant rate of force to automatically raise the closure to its full open position upon being opened and released and wherein substantially uniform force rates are achievable irrespective of manufacturing and tolerance variations in the torque rods and other hinge assembly parts.

Another object of the present invention is to provide a new and improved hinge assembly, as defined in the preceding object, and wherein the hinge assembly comprises a stationary hinge member which is adapted to be secured to a wall of the compartment, a hinge strap adapted to be secured to the closure member and which is pivotally supported by the hinge member for movement about a generally horizontal first axis, a link pivotally supported by the stationary hinge member for movement about a generally horizontal second axis spaced from the first axis, a roller carried by the hinge strap and engageable with the link along its upper contoured cam surface, and a torsion rod having one end stationarily secured and its other end disposed within a notch in the link located adjacent its end remote from its pivotal connection to the hinge member, and wherein the torsion rod is stressed so as to biasingly hold the upper cam surface of the link in constant engagement with the roller and to exert an upward force on the hinge strap, and wherein the cam surface includes a first cam portion which is contoured such that a controlled substantially constant rate of force is applied to the closure member when the latter is moved from its closed to its open position and wherein it has a second cam surface portion adjacent the end of the link which is contoured such that a force greater then the upward movement forces is required to initially move the closure member from its open position towards its closed position.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

The present invention provides a novel hinge assembly 10 for a swinging closure member which is adapted to be raised and lowered to open and close an opening in a compartment in an automotive vehicle. Although the novel hinge aassembly 10 could be used for various swinging closure members, such as a hood or tailgate, it is particularly suitable for use with a trunk or deck lid and will be herein described for use with that purpose.

Figure 1:
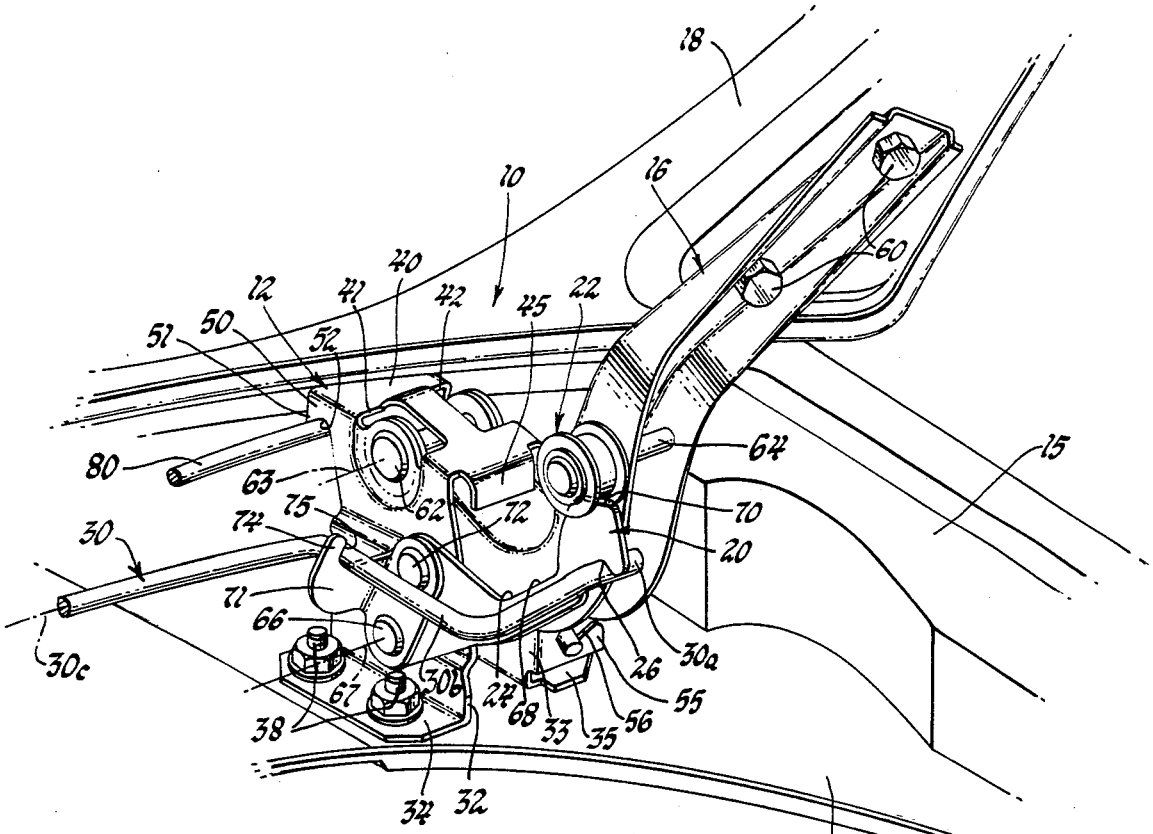
FIG. 1 is a fragmentary perspective view of a trunk and deck lid of an automotive vehicle and which shows the novel hinge assembly of the present invention.

Referring to FIG. 1 of the drawings, the novel hinge assembly 10 comprises, in general, a stationary hinge member 12 which is adapted to be secured to a ledge or wall 14 of the trunk compartment 15, a hinge strap 16 which is secured to a deck lid 18 and which is pivotally supported by the stationary hinge member 12 for movement about a generally horizontal first axis, a link 20 pivotally supported by the stationary hinge member 12 for movement about a generally horizontal second axis spaced from the first axis, a roller 22 carried by the hinge strap 16 and engageable with the link along its upper cam surface 24, and a torsion rod 30 having one end stationarily secured and its other end disposed within a notch 26 in the link 20 located at its end remote from its pivotal connection to the hinge member 12. The torsion rod 30 is stressed so as to biasingly hold the upper cam surface 24 of the link 20 in constant engagement with the roller 22 to exert a constant upward force on the hinge strap 16 to bias the deck lid 18 towards its open position.

It should be noted that only the right side hinge assembly is shown in the drawings and that an identical hinge assembly would be located adjacent the left side of the vehicle.

The stationary hinge member 12 comprises a one piece sheet metal stamping having a generally inverted U-shape. The stationary hinge member 12 includes a pair of spaced apart side walls 32 and 33 and a pair of flanges 34 and 35 extending perpendicular to the side walls 32 and 33, respectively. The flanges 34 and 35 abuttingly engage the ledge 14 of the trunk compartment 15 and are secured to the ledge 14 via bolts 38 to hold the stationary hinge member 12 in place.

The hinge member 12 also has a top or bight 40. The top 40 has a pair of cut outs or slots 41 and 42 to define openings therethrough and the rearward end of the top 40 is bent downwardly to form a stop 45. The hinge top 40 also includes a forwardly projecting portion 50 with a pair of spaced downwardly extending ears 51 to define a recess or cut out 52 for a reason to be hereinafter noted. The side 33 of the stationary hinge member 12 includes a laterally extending ear 55 provided with a recess or cut out 56 for a reason to be hereinafter noted.

The stationary hinge member 12 pivotally supports the strap 16. The strap 16 is a gooseneck shaped strap stamped from sheet metal so as to have generally inverted U-shape cross section shape. The hinge strap 16 at its rearward end is flared and secured to the underside of the deck lid 18 via a pair of bolts 60. The gooseneck hinge strap at its forward end is pivotally connected to the sides 32 and 33 of the stationary hinge member 12 by a pivot pin means 62 for pivotal movement about a horizontal axis 63. The hinge strap 16 also rotatably supports the roller 22 via a suitable pivot pin means 64. The roller 22 is disposed laterally of the hinge strap 16 and is adapted to be engaged by the link 20.

The link 20 is pivotally supported by the side 32 of the stationary hinge member 12 via a pivot pin means 66 for movement about a horizontal axis 67 which is spaced from the horizontal axis 63. The link 20 has an upper cam surface which, as shown in the drawings, is contoured so as to provide a first cam surface portion 68 and a second cam surface portion 70. Secured to the link 20 is an L-shaped member 71. The L-shaped member 71 is secured to the link by a rivet 72 and by the pivot pin means 66. The L-shaped member 71 includes an ear 74 having a recess 75 and for a reason to be hereinafter noted. The link 20 also has the aforementioned notch or recess 26 adjacent its bottom surface and at its end remote from the end to which it is pivotally connected to the stationary hinge member 12.

Figure 2:
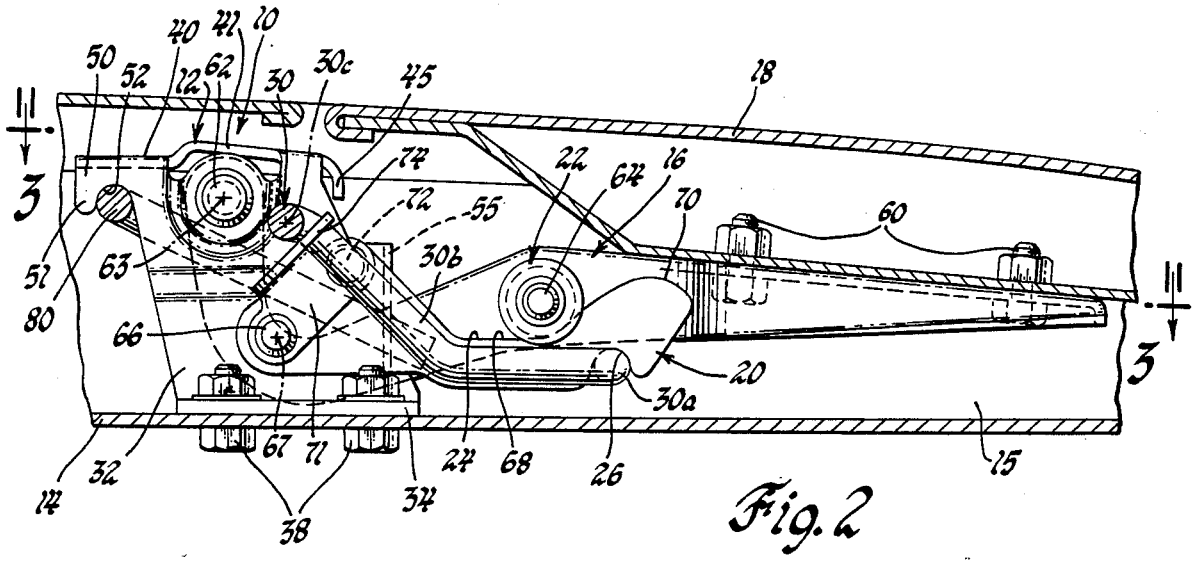
FIG. 2 is a side elevational view of the novel hinge assembly, with the deck and adjacent trunk structure shown in cross section and in their closed position.
Figure 3:
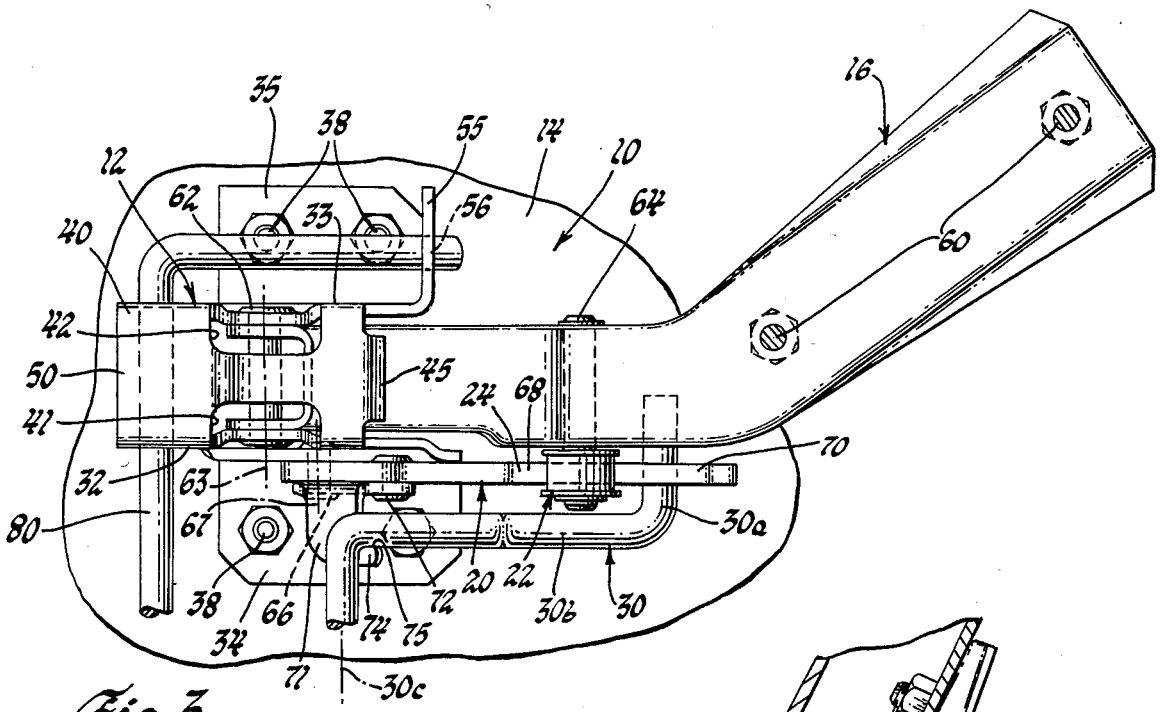
FIG. 3 is a top elevational view of the novel hinge assembly, with part shown in section and taken along the line 3—3 of FIG. 2.
Figure 4:
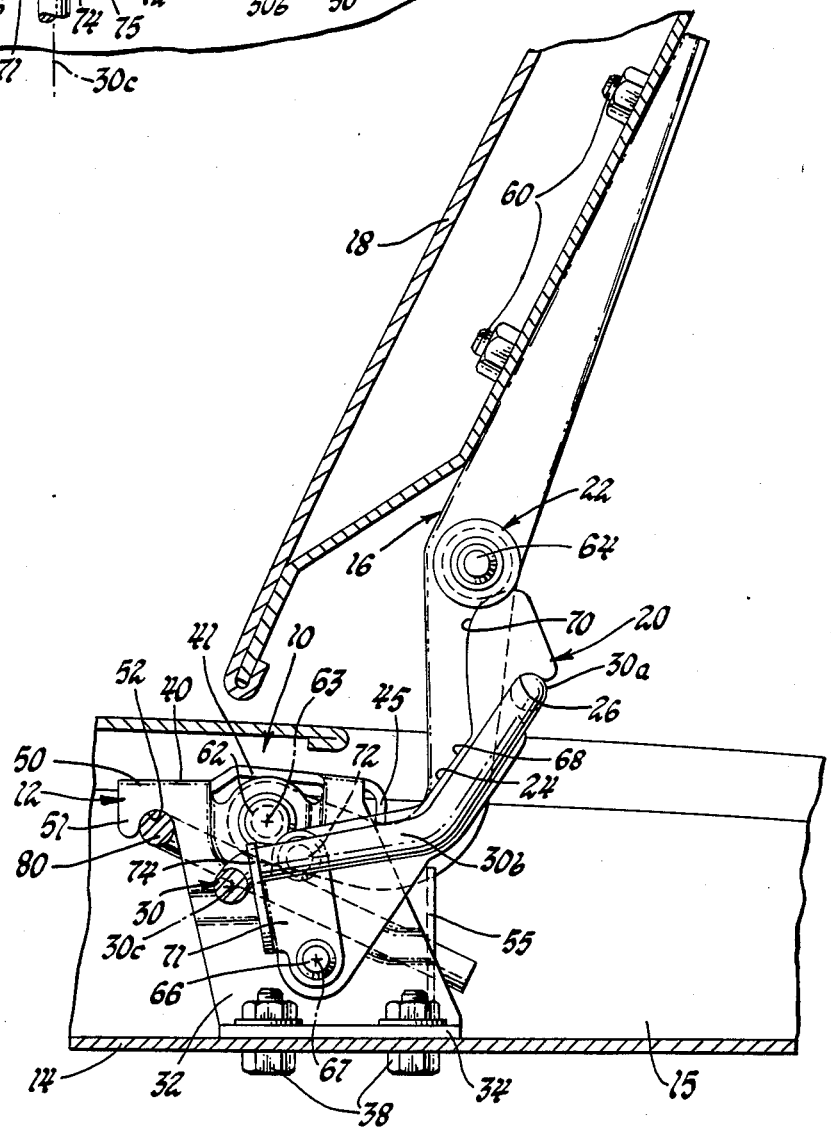
FIG. 4 is a side elevational view like that shown in FIG. 2, but with the deck lid and hinge part shown in their open position.

The link 20 is biased into engagement with the roller 22 by the torsion rod 30. The torsion rod 30 is stationarily secured adjacent one end to the left hand hinge assembly (not shown) adjacent the left side of the trunk compartment 15. The torsion rod 30 at its other end is L-shaped and has one leg **30*a* disposed within the notch 26 of the link 20. The other leg 30*b* of the L-shaped end is disposed within the recess 70 on the ear 74. This arrangement retains the torsion rod 30 in place and yet allows it to pivotally move about is axis 30*c* from the position shown in FIG. 2 to the position shown in FIG. 4 and vice versa. The torsion rods 30 is stressed when assembled to the hinge assembly 10 so that it biases the link 20 in a counterclockwise direction, as viewed in FIGS. 1 and 2 and into engagement with the roller 22. The loading on the torsion rods 30 is such that when the deck lid 18 is opened the deck lid 18 is caused to be automatically moved from its closed position, as shown in FIG. 2, towards its open position, as shown in FIGS. 1 and 4. This opening movement takes place until the gooseneck hinge strap 16 abuts the stop 45 on the stationary hinge member 12**.

The stationary hinge member 12 also serves as an anchor for a torsion rod 80 for operating the left side hinge assembly adjacent the left side of the vehicle. To this end, the end of the torsion rod 80 is in engagement with the rearward projecting portion 50 of the top 40 of the hinge member 12 by being disposed within the recess 52 and is bent so as to be in engagement with the laterally extending flange 55 by being disposed within the recess 56. This arrangement stationarily holds the end of the torsion rod 80 in place. The torsion rod 30 has its one end stationarily anchored in the left side hinge assembly (not shown) in the same manner in which the torsion rod 80 is anchored to the hinge member 12 of the hinge assembly 10.

In operation, when the deck lid 18 is opened via a key operated lock (not shown) the torsion rod 30 causes the deck lid 18 to be moved -rom its closed position, as shown in FIG. 2, to its open position, as shown in FIGS. 1 and 4. This movement takes place automatically and at a controlled rate. The contour of the cam surface portion 68 of the control link 20 causes this movement to be controlled at a substantially constant rate. That is because the contour of the cam surface portion 68 and the moment arm of the pivot link 20 with respect to the hinge strap 16 changes as it is being moved upwardly so as to provide a more or less constant force rate. This movement occurs until the gooseneck hinge engages the stop 45.

As best shown in FIGS. 1 and 4 when the deck lid is in fully open position, the roller 22 will be in abutting engagement with the second cam surface portion 70. The contour of the second cam surface portion is such that it requires a force greater than the force for moving the deck lid 18 upwardly to begin to move the deck lid 18 downwardly against the bias of the torsion spring 30. When the deck lid 18 is moved slightly towards its closed position, the roller 22 will be again in engagement with the first cam surface portion 68 and the amount of force required to close the lid will be substantially less.

An important feature of the present invention is the provision of the control link 20. By providing a control link 20, a more uniform controlled rate of force can be applied to the hinge straps 16 from hinge assembly to hinge assembly irrespective of the tolerance variations in the torsion rods and the tolerance variations in the other hinge parts. It is difficult to consistently manufacture torsion rods which provide the same uniform torque. But by using the control link and contouring its cam surface in a specific manner more consistent results can be obtained from hinge assembly to hinge assembly than could be obtained by direct engagement between the roller and the torsion rod, as shown in the above-noted patents.

From the foregoing it should be apparent that a novel hinge assembly has been provided which can utilize a torque rod spring means and which will provide for more uniform consistent results from hinge assembly to hinge assembly.

Although the illustrated embodiment thereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. A hinge assembly for a swinging closure member adapted to be raised and lowered to open and close an opening in a compartment of an automotive vehicle comprising:

a stationary hinge member adapted to be secured to a wall of the compartment, a hinge strap adapted to be secured to the closure member and which is pivotally supported by said stationary hinge member via a first pivot means for movement about a generally horizontal first axis, a link pivotally supported by said stationary hinge member via a second pivot means for movement about a generally horizontal second axis spaced from said first axis, a roller carried by said hinge strap and engageable with said link along its upper surface, a torsion rod having one end stationarily secured and its other end disposed within a notch in said link located adjacent its end remote from its pivotal connection to the stationary hinge member, said torsion rod being stressed so as to biasingly hold said upper surface of said link in constant engagement with said roller and to exert an upward biasing force on said hinge strap when the closure member is in its closed position, open position and during its movement between said positions, said upper surface defining first cam surface portion which is contoured so that a controlled substantially constant rate of force is applied to the closure member when the latter is moved from its closed position to its open position, said upper surface having a second cam surface portion adjacent the end of said link remote from its pivotal connection with the stationary hinge member which is contoured such that a force greater than the upward movement force is required to initially move the closure member from its open position toward its closed position.

2. A hinge assembly for a swinging closure member adapted to be raised and lowered to open and close an opening in a compartment of an automotive vehicle comprising:

a stationary hinge member adapted to be secured to a wall of the compartment, a hinge strap adapted to be secured to the closure member and which is pivotally supported by said stationary hinge member via a first pivot means for movement about a generally horizontal first axis, a link pivotally supported by said stationary hinge member via a second pivot means for movement about a generally horizontal second axis spaced from said first axis, a roller carried by said hinge strap and engageable with said link along its upper surface, a torsion rod having one end stationarily secured and its other end disposed within a notch in said link located adjacent its end remote from its pivotal connection to the stationary hinge member, said torsion rod adjacent its other end being also pivotally supported by the stationary hinge member for pivotal movement about a generally horizontal axis, said torsion rod being stressed so as to biasingly hold said upper surface of said link in constant engagement with said roller and to exert an upward biasing force on said hinge strap when the closure member is in its closed position, open position and during its movement between said positions, said upper surface defining first cam surface portion which is contoured so that a controlled substantially constant rate of force is applied to the closure member when the latter is opened to move the closure member from its closed position to its open position, said upper surface having a second cam surface portion adjacent the end of said link remote from its pivotal connection with the stationary hinge member which is contoured such that a force greater than the upward movement force is required to initially move the closure member from its open position toward its closed position.

3. In an automotive vehicle having body structure defining a trunk compartment having an opening, a deck lid adapted to be raised and lowered to open and close said opening, and a pair of hinge assemblies for swingably supporting said deck lid for opening and closing movement, each of said hinge assemblies comprising:

a stationary hinge member adapted to be secured to said body structure adjacent said opening in said compartment, a hinge strap adapted to be secured to the deck lid and which is pivotally supported by said stationary hinge member via a first pivot pin means for movement about a generally horizontal first axis, a link pivotally supported by said stationary hinge member via a second pivot pin means for movement about a generally horizontal second axis spaced from said first axis, a roller carried by said hinge strap and engageable with said link along its upper surface, a torsion rod having one end stationarily secured to one of said hinge assemblies and its other end disposed within a notch in said link located adjacent its end remote from its pivotal connection to the stationary hinge member of the other hinge assembly, said torsion rod adjacent its other end being also pivotally supported by the stationary hinge member of said other hinge assembly for pivotal movement about a generally horizontal axis, said torsion rod being stressed so as to biasingly hold said upper surface of said link in constant engagement with said roller and to exert an upward biasing force on said hinge strap when the deck lid is in is closed position, open position and during its movement between said positions, said upper surface having a first cam surface portion which is contoured so that a controlled substantially constant rate of force is applied to the deck lid when the latter is opened to move the deck lid from its closed position to its open position, said upper surface having a second cam surface portion adjacent the end of said link remote from its pivotal connection with the adjacent stationary hinge member which is contoured such that a force greater than the upward movement force is required to initially move the deck lid from its open position toward its closed position.

* * * * *